United States Patent [19]

Burton et al.

[11] 4,301,866

[45] Nov. 24, 1981

[54] METHOD AND APPARATUS FOR IGNITING AN IN SITU OIL SHALE RETORT

[75] Inventors: Robert S. Burton, Grand Junction; Sten I. Rundberg, Debeque; James V. Vaughn, Debeque; Thomas P. Williams, Debeque; Gregory C. Benson, Grand Junction, all of Colo.

[73] Assignee: Occidental Oil Shale, Inc., Grand Junction, Colo.

[21] Appl. No.: 119,857

[22] Filed: Feb. 8, 1980

[51] Int. Cl.[3] ..... E21B 43/243; E21B 36/02

[52] U.S. Cl. ..... 166/260

[58] Field of Search ..... 166/57, 59, 260, 302

[56] References Cited

U.S. PATENT DOCUMENTS

| | | | |
|---|---|---|---|
| 2,188,737 | 1/1940 | Hixon | 166/59 |
| 2,668,592 | 2/1954 | Piros et al. | 166/272 |
| 2,853,136 | 9/1958 | Moore et al. | 166/266 |
| 2,902,270 | 9/1959 | Salomonsson et al. | 166/59 X |
| 3,204,696 | 9/1965 | De Priester et al. | 166/59 |
| 3,254,721 | 6/1966 | Smith | 166/59 |
| 3,315,745 | 4/1967 | Rees, Jr. | 166/59 |
| 3,680,636 | 8/1972 | Berry et al. | 166/302 |
| 3,990,835 | 11/1976 | Burton | 431/353 |
| 4,136,737 | 1/1979 | Howard et al. | 166/251 |
| 4,137,968 | 2/1979 | Howard et al. | 166/53 |

*Primary Examiner*—Stephen J. Novosad

*Attorney, Agent, or Firm*—Christie, Parker & Hale

[57] ABSTRACT

A technique is provided for igniting an in situ oil shale retort having an open void space over the top of a fragmented mass of particles in the retort. A conduit is extended into the void space through a hole in overlying unfragmented formation and has an open end above the top surface of the fragmented mass. A primary air pipe having an open end above the open end of the conduit and a liquid atomizing fuel nozzle in the primary air pipe above the open end of the primary air pipe are centered in the conduit. Fuel is introduced through the nozzle, primary air through the pipe, and secondary air is introduced through the conduit for vortical flow past the open end of the primary air pipe. The resultant fuel and air mixture is ignited for combustion within the conduit and the resultant heated ignition gas impinges on the fragmented mass for heating oil shale to an ignition temperature.

14 Claims, 5 Drawing Figures

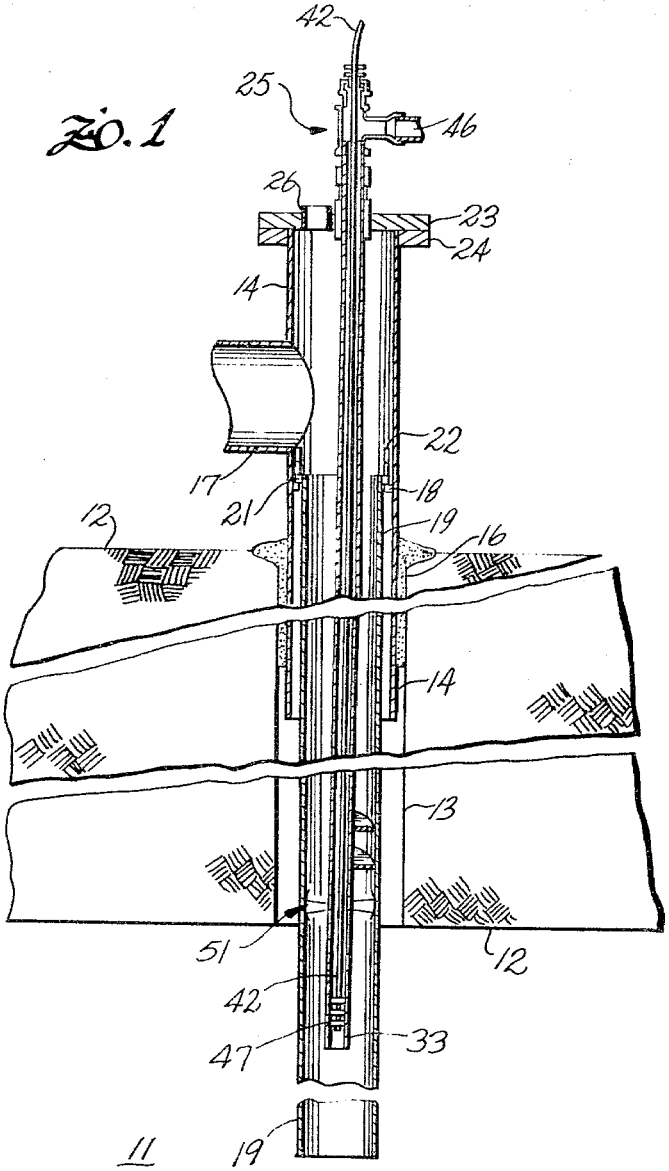
Fig. 1
42
25
46
26
23
24
14
22
17
21
18
19
16
12
14
13
51
12
42
47
33
11
19
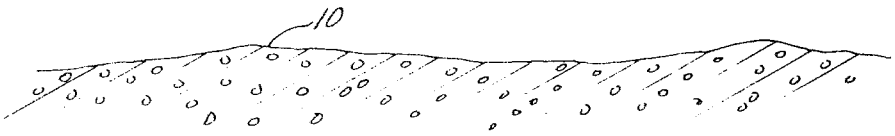
10

METHOD AND APPARATUS FOR IGNITING AN IN SITU OIL SHALE RETORT

The Government of the United States of America has rights in this invention pursuant to Agreement No. ET-77-A-03-1848 with the Department of Energy.

BACKGROUND OF THE INVENTION

This invention relates to a method and burner for igniting a fragmented permeable mass of formation particles containing oil shale within an in situ oil shale retort in a subterranean formation containing oil shale.

The presence of large deposits of oil shale in the Rocky Mountain region of the United States has given rise to extensive efforts to develop methods for recovering shale oil from kerogen in the oil shale deposits. It should be noted that the term "oil shale" as used in the industry is, in fact, a misnomer. It is neither shale nor does it contain oil. It is a sedimentary formation comprising marlstone deposit with layers containing an organic polymer called "kerogen" which, upon heating, decomposes to produce liquid and gaseous products. It is the formation containing kerogen that is called "oil shale" herein and the liquid hydrocarbon product is called "shale oil".

A number of methods have been proposed for processing oil shale which involve either first mining the kerogen bearing shale and processing the shale on the ground surface or processing the oil shale in situ. The latter approach is preferable from the standpoint of environmental impact since the treated shale remains in place reducing the chance of surface contamination and the requirement for disposal of solid wastes.

The recovery of liquid and gaseous products form oil shale deposits has been described in several patents such as U.S. Pat. Nos. 3,661,423; 4,043,595; 4,043,596; 4,043,597; 4,043,598; 4,118,071; and 4,153,298, as well as pending applications including U.S. Patent Application Ser. No. 929,250 filed July 31, 1978, by Thomas E. Ricketts, now U.S. Pat. No. 4,192,554. Each of these patents and the application is assigned to Occidental Oil Shale, Inc., assignee of this application and each is incorporated herein by this reference.

These patents describe in situ recovery of liquid and gaseous hydrocarbon materials from a subterranean formation containing oil shale wherein such formation is explosively expanded towards one or more excavated voids to form a stationary fragmented permeable mass of formation particles containing oil shale within the formation, referred to herein as an in situ oil shale retort or merely as a retort.

Retorting gases are passed through the fragmented mass to convert kerogen contained in the oil shale to liquid and gaseous products. One method for supplying hot retorting gases used for retorting kerogen contained in the oil shale, as described in the aforementioned patents, includes establishing a combustion zone in an upper portion of the retort and introducing an oxygen supplying retort inlet mixture into the retort to advance the combustion zone downwardly through the fragmented mass. In the combustion zone oxygen from the retort inlet mixture is depleted by reaction with hot carbonaceous materials to produce heated combustion gas and combusted oil shale. By the continued introduction of the retort inlet mixture into the fragmented mass, the combustion zone is advanced through the fragmented mass in the retort.

The combustion gas and the portion of the retort inlet mixture that does not take part in the combustion process pass downwardly through the fragmented mass on the advancing side of the combustion zone to heat the oil shale in a retorting zone to a temperature sufficient to produce kerogen decomposition called "retorting". Such decomposition of the oil shale produces gaseous and liquid products including shale oil and a residual carbonaceous material.

The liquid products and the gaseous products are cooled by the cooler oil shale fragments in the retort on the advancing side of the retorting zone. The liquid hydrocarbon products, together with water produced in or added to the retort, collect at the bottom of the retort and are withdrawn. An off gas is also withdrawn from the bottom of the retort. Such off gas can include carbon dioxide generated in the combustion zone, gaseous products produced in the retorting zone, carbon dioxide from carbonate decomposition, and any gaseous retort inlet mixture that does not take part in the combustion process.

Establishment of a combustion zone in the fragmented mass involves heating a portion of the fragmented mass adjacent its upper surface to an ignition temperature so that carbonaceous material in oil shale is burned to supply heat for retorting. Ignition requires a substantial amount of heat delivered over a sufficient time to raise the temperature of particles containing oil shale above an ignition temperature. In a large retort several burners may be needed at the same time for igniting the top of a fragmented mass at several locations to assure uniformity in the combustion zone. It is therefore desirable to provide an inexpensive and reliable burner for igniting an in situ oil shale retort from a remote location.

It has been found upon forming a retort generally in accordance with the description in U.S. Patent Application Ser. No. 929,250, now U.S. Pat. No. 4,192,554, that the fragmented mass of particles in the retort did not completely fill the retort cavity. That is, a void space remained between the upper surface of the fragmented mass and overlying unfragmented formation.

When a void space exists over the top of a fragmented mass in the retort it can be desirable to place a burner in the void space for heating an upper portion of the fragmented mass with limited heating of the overlying unfragmented formation. It is desirable to impinge heated ignition gas on the fragmented mass and minimize radiant heating of overlying formation. A burner is desirable for use in a void space over a fragmented mass which operates essentially independently of the height of such a void space.

This invention is related to the invention disclosed in U.S. Patent Application Ser. No. 47,715, filed June 12, 1979, entitled APPARATUS AND METHOD FOR IGNITING AN IN SITU OIL SHALE RETORT, now U.S. Pat. No. 4,245,701, which is a continuation of U.S. Patent Application Ser. No. 953,477, filed Oct. 23, 1978, by Carlon C. Chambers and now abandoned. These patent applications are incorporated herein by this reference.

BRIEF SUMMARY OF THE INVENTION

A fragmented permeable mass of formation particles in an in situ oil shale retort is ignited in practice of this invention. A hole is formed through unfragmented formation to a void space between the top of the fragmented mass and overlying unfragmented formation. A conduit is extended through the hole into the void space with an open end above the top of the fragmented mass. A burner assembly is centered in the conduit comprising a primary air pipe having an open end above the open end of the conduit and a liquid atomizing fuel nozzle in the primary air pipe above the open end of the primary air pipe. Fuel is introduced through the nozzle, primary air is introduced through the pipe, and secondary air is introduced through the conduit for vortical flow past the open end of the primary air pipe. The resultant fuel and air mixture is ignited for heating an upper portion of the fragmented mass to an ignition temperature.

DRAWINGS

These and other features and advantages of the present invention will be appreciated as the same becomes better understood by reference to the following detailed description when considered in connection with the accompanying drawings wherein:

FIG. 1 illustrates in semi-schematic vertical cross section a burner system for ignition of an in situ oil shale retort;

DESCRIPTION

Figure 2:
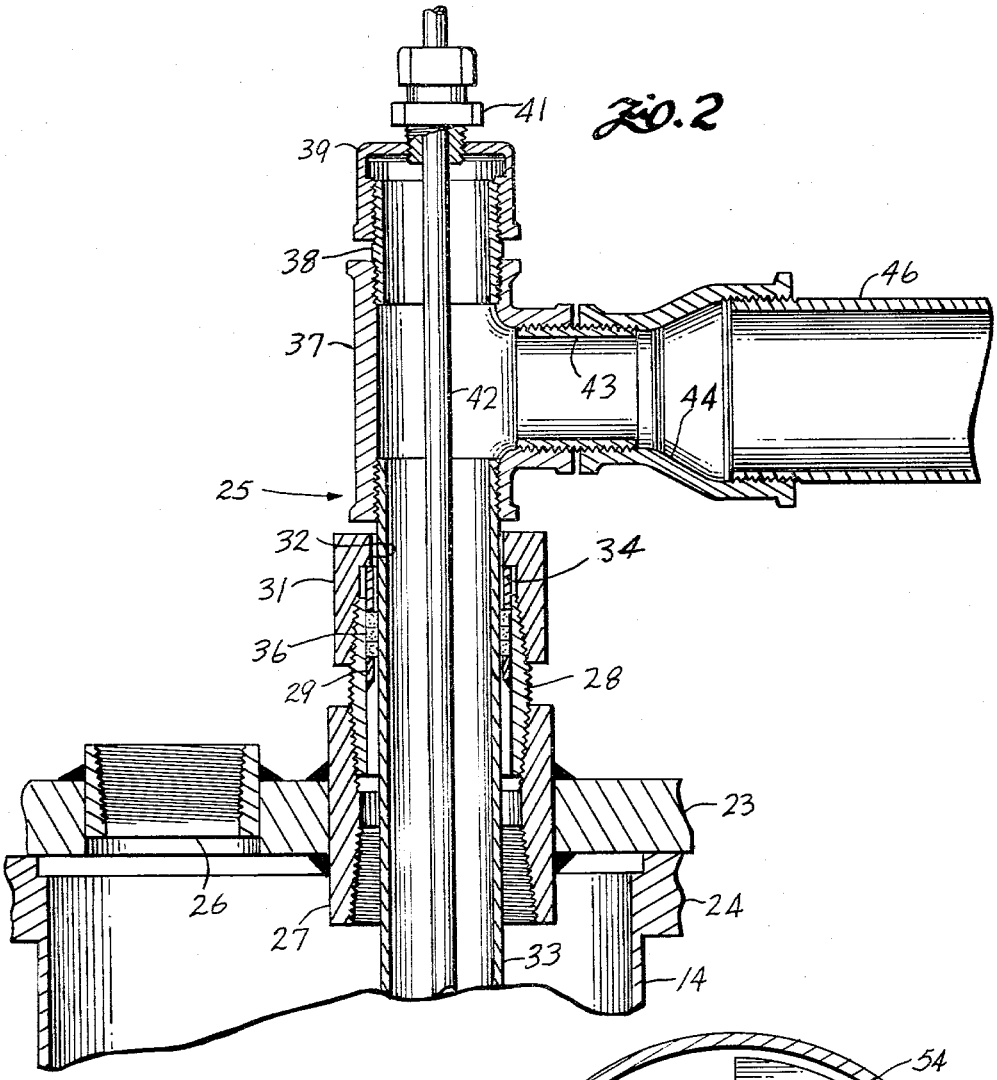
FIG. 2 is a fragmentary vertical cross section of an upper portion of the burner system.

FIG. 1 illustrates in semi-schematic vertical cross section a region adjacent the upper boundary of an in situ oil shale retort. Some of the vertical scale in this drawing is distorted or deleted for clarity of illustration. Dimensions of parts of the burner system are variable, and such variations and distortions will be apparent from exemplary dimensions included hereinafter.

As illustrated herein an in situ oil shale retort has been formed in a subterranean formation containing oil shale by any of a variety of techniques including those in patents referred to hereinabove. The retort contains a fragmented permeable mass 10 of formation particles for retorting. A void space 11 exists between the top surface of the fragmented mass 10 and overlying unfragmented formation 12. A hole 13 is formed through the unfragmented formation to the void space 11. Such a hole can be drilled before or after the fragmented mass is formed in the retort. The upper end of the hole 13 communicates with an open work area which can be an overlying base of operation as described in U.S. Pat. No. 4,118,071, a subterranean air level drift, or the ground surface, if desired. Preferably, the thickness of unfragmented formation 12 between the void space over the top of the fragmented mass and the work area is at least about 50 feet to retain adequate strength.

A casing 14 is cemented in the upper end of the hole 13 by a cement grout 16 or the like. The upper end of the casing extends a few feet above the floor of unfragmented formation. A lateral duct 17 connects to the side of the casing for introduction of combustion air. The lower end of the casing can be a substantial distance above the void space in the retort and the casing need only be long enough to provide reasonable strength and gas sealing to adjacent unfragmented formation.

A landing ring 18 is welded inside the casing below the lateral duct 17 and somewhere near floor level. A secondary air conduit 19 having a flange 21 at its upper end is lowered through the casing 14 by way of eye bolts 22 or the like until the flange 21 rests on the landing ring 18. This suspends the secondary air conduit through the hole communicating with the void space over the fragmented mass in the retort. Preferably the open lower end of the secondary air conduit is a couple feet above the top surface of the fragmented mass 10 in the retort. In an exemplary embodiment the outer casing 14 can be 8 inch steel pipe and the inner conduit 19 can be 6 inch steel pipe. Short segments of pipe can be threaded, bolted or welded together for convenience in handling in underground operations.

FIG. 2 illustrates in greater detail a subassembly 25 at the upper end of the casing 14 for supporting a burner assembly in the casing. Much of the upper end subassembly can be assembled from standard pipe fittings. A plate 23 is bolted to a flange 24 on the top of the casing. One-half of a pipe coupling 26 is welded into a hole through the plate to provide access to the inside of the casing with concomitant ease of plugging such access with an ordinary pipe plug (not shown). A two inch pipe coupling 27 is welded through another hole through the top plate 23. The coupling 27 receives a close nipple 28 which has a ring 29 welded inside its bore at about the middle of the length of the nipple. Alternatively, a nipple can be partially bored out to provide an internal shoulder. A pipe cap 31 having an axial clearance hole 32 is threaded onto the close nipple 28.

A one and one-quarter inch diameter steel primary air pipe 33 passes through the clearance hole 32 through the pipe cap and coupling 27 so as to hang in the casing 14 and conduit 19. A ring 34 inside the pipe cap 31 bears against a resilient packing gland assembly 36 within the close nipple 28. Tightening of the pipe cap 21 compresses the packing gland 36 against the ring 29 in the close nipple 28 thereby squeezing against the sides of the primary air pipe 33. Such a packing assembly readily supports the primary air pipe in any of a plurality of vertical positions in the conduit as well as providing a gas seal.

A pipe tee 37 is threaded on the upper end of the primary air pipe and receives a close nipple 38 and cap 39 at its upper end. A conventional tubing passthrough 41 is threaded into a hole through the pipe cap 39 and supports a fuel supply tube 42, which extends down through the primary air pipe 33. A removable in-line prefilter (not shown) is preferably connected in the fuel supply line 42 in the vicinity of the top assembly to prevent plugging of the fuel atomizing nozzle 47 (FIG. 1). A close nipple 43 on the side arm of the tee 37 receives a reducer 44 which is connected to a primary air supply line 46.

A liquid fuel atomizing nozzle 47 (FIG. 1) is mounted on the lower end of the fuel supply tube 42. The nozzle 47 is centered in the primary air supply pipe 33. It is located about one pipe diameter (e.g., about one inch) above the lower open end of the primary air supply pipe.

Figure 5:
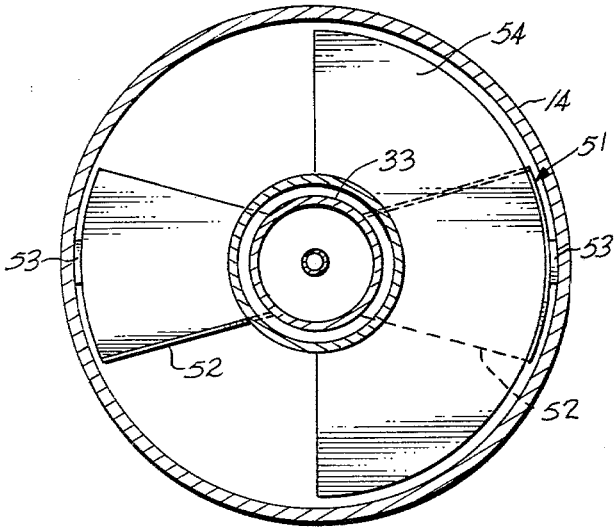
FIG. 5 is a horizontal cross section near the lower end of the burner system.
Figure 3:
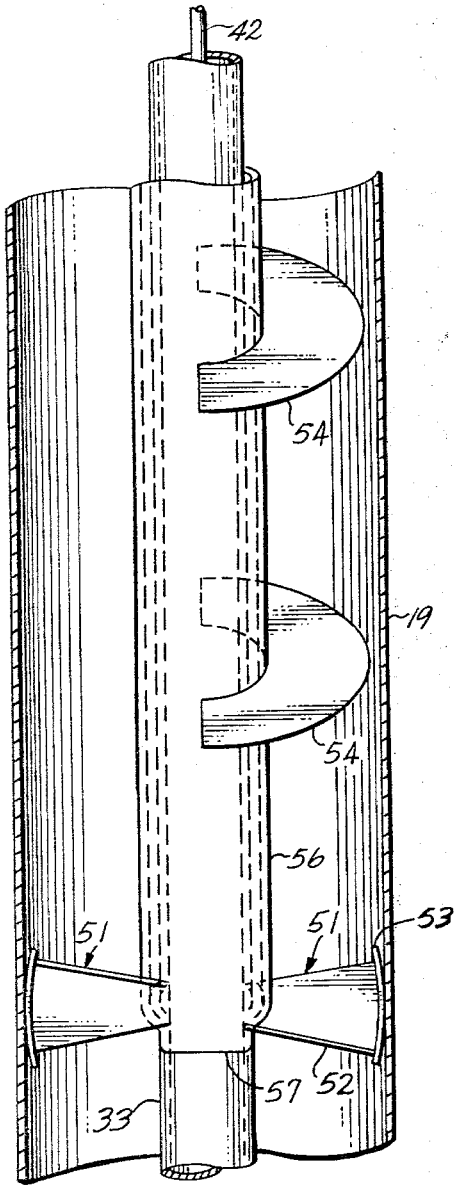
FIG. 3 is a vertical cutaway view showing in greater detail a means for swirling secondary air near a lower end of the burner system.
Figure 4:
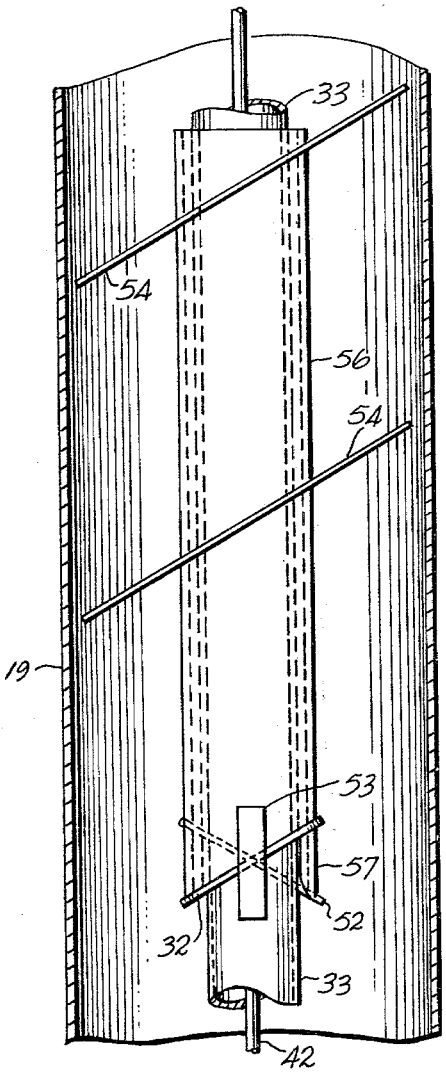
FIG. 4 is a vertical cutaway view orthogonal to the view of FIG. 3.

The lower end of the primary air supply pipe 33 is centered in the secondary air conduit 19 by a pair of centering spokes 51, best seen in the detailed drawings of FIGS. 3 to 5. Each of the spokes 51 comprises a flat plate 52 welded to the primary air supply pipe and extending generally radially therefrom. Each of the plates is skewed about 30° from a plane normal to the axis of the pipe. A curved guide 53 is welded to the outer end of each of the plates 52 in a location to fit closely within the secondary air conduit 19. The guides keep the primary air pipe substantially centered in the secondary air conduit and prevent binding as the primary air pipe is introduced into the secondary air conduit. The primary air pipe centers the fuel nozzle in the secondary air conduit.

Just above the spokes 52 there are two or three vanes 54 in the annulus between the primary air pipe and the secondary air conduit. Each of the vanes is in the form of a flat plate tilted at an angle of about 30° from a plane perpendicular to the axis of the primary air pipe. Each vane extends around the primary air pipe substantially less than the full periphery of the secondary air conduit to permit passage of an ignition flare along the length of the annulus. In the illustrated embodiment each vane 54 extends above half way around the periphery so that about half of the annulus is not obstructed by the vanes.

The vanes can be welded directly on the primary air pipe or, as in the illustrated embodiment, welded on a short length of pipe 56 loosely fitted around the primary air pipe. The lower end of the short length of pipe 56 on which the vanes are mounted has a pair of extending tongues 57 which fit between the spokes 51 and retain the vanes in a selected position relative to the spokes. In such an arrangement if the vanes 54 and pipe 56 are added to the burner system after the primary air pipe has been lowered through the secondary air conduit, the vane assembly spins as it drops and readily falls into place with the tongues 57 between the spokes.

During operation of the burner system for igniting an in situ oil shale retort, diesel oil or heated shale oil is introduced by way of the fuel supply tube 42 and is atomized by the nozzle 47. A nozzle orifice as small as 0.003 inch can be used to give good atomization. Liquid fuel is preferred for ignition so that the volume can be kept low. Thus the fuel supply tube does not unduly obstruct the air flow conduit. Diesel oil or heated shale oil are preferred fuels since they are readily available, easily ignited, and safe for use in underground operations. If shale oil is used it is preferably preheated for ease of handling and good atomization.

Primary air for combustion is introduced by way of the air supply line 46 connected to the upper end subassembly 25 and the primary air pipe 33. The atomized fuel mixes with the primary air and forms a mixture at the lower end of the primary air pipe which is readily ignited and forms a stable flame in which the fuel is completely burned. Mixing of the fuel and primary air in the short length between the nozzle and the open end of the primary air pipe appears important to assure complete combustion when the total flow of primary and secondary air is more than needed for stoichiometric combustion. If the fuel nozzle is much more than about one pipe diameter above the open end of the primary air pipe, burning can occur in the pipe leading to overheating of the end of the primary air pipe and fuel nozzle.

Secondary air is introduced by way of the side duct 17 on the casing 14 and passes downwardly through the annulus between the primary air pipe 33 and secondary air conduit 19. The vanes 54 and flat plates 52 of the spokes impart vortical flow to the secondary air as it passes along the annulus. The swirling secondary air mixes with the burning mixture of fuel and primary air and helps sustain combustion and is itself heated to a sufficiently elevated temperature for heating oil shale in the fragmented mass to an ignition temperature. The quantity of primary air plus secondary air is more than needed for stoichiometric burning of the fuel to assure efficient use of the fuel and also to provide excess oxygen in the heated ignition gas for combustion of carbonaceous material in the oil shale.

The lower end of the primary air pipe is spaced above the open end of the secondary air conduit for sustaining combustion of the fuel within that conduit. With the lower end of the primary air pipe from about four and one-half to about ten feet above the lower end of the secondary air conduit, no visible flame is seen from the lower end of the conduit with total air flow rates as high as 1000 standard cubic feet per minute (SCFM). By keeping the flame within the secondary air conduit, regenerative heating helps assure efficient combustion and radiant heating of overlying formation is minimized.

Spacing the open end of the secondary air conduit in the open void space above the top surface of the fragmented mass in the retort permits some spreading of the heated ignition gas from the conduit before the gas impinges on the surface of the fragmented mass. Inadvertent fusion of formation particles can be avoided. Swirling of the secondary air by the vanes provides good mixing of the secondary air and burning mixture of fuel and primary air. It also tends to spread the heated ignition gas over an area on the top of the fragmented mass which is larger than the end of the conduit. By keeping the open end of the conduit a couple feet above the surface of the fragmented mass, it can be assured that the temperature of a portion of the mass is raised to the ignition temperature of oil shale for establishing a combustion zone in the fragmented mass.

If the open end of the conduit is too far above the top surface of the fragmented mass, the heated ignition gas can spread over a broad area before entering the permeable fragmented mass. The consequent cooling can yield too low a temperature for assured ignition in the fragmented mass. A technique as described in aforementioned patent application Ser. No. 47,715, now U.S. Pat. No. 4,245,701, may not be suitable for ignition of an in situ oil shale retort with a substantial void space between the top of the fragmented mass and overlying unfragmented formation since heated ignition gas may not remain sufficiently concentrated to raise the temperature of the fragmented mass to ignition in a reasonable time.

With a burner assembly as provided herein, the primary air pipe and fuel nozzle can be selectively positioned away from the end of the secondary air conduit so that the flame is contained in the secondary air conduit and a heated ignition gas is emitted from the secondary air conduit. The open end of the secondary air conduit can be positioned at an optimum distance from the top surface of the fragmented mass in the retort for localized ignition and subsequent spreading of the combustion zone in the fragmented mass.

Ignition of the combustible mixture of primary air and atomized fuel is readily accomplished by lowering a burning fusee or flare through the open pipe coupling 26 at the top of the burner assembly. The flare is lowered until in the vicinity of the lower end of the primary air pipe and can be maintained in that position until a stable flame is produced. After ignition of the burner is assured, the coupling can be plugged.

It has been found from tests that primary air mixed with the fuel is of importance. A burner assembly without a primary air pipe and flow of primary air was unsuccessful for the purpose since combustion did not take place at the burner nozzle and the combustion that did occur was at least partly below the open end of the secondary air conduit. The combustion was incomplete, resulting in wasted fuel. Use of primary air and a fuel nozzle spaced about one pipe diameter above the lower end of the primary air pipe proved quite satisfactory.

With such a burner arrangement fuel flow rates from about one quart of diesel oil per minute to about 0.6 gallons of diesel oil per minute are satisfactory and total air flow rates from about 600 to 1000 SCFM can be used.

In one test of a burner system as hereinabove described and illustrated, the lower end of the primary air pipe and fuel nozzle were positioned about 4 feet 8 inches above the lower end of the secondary air conduit. The lower end of the secondary air conduit was positioned about two feet above the top surface of a fragmented mass of particles. The burner was operated with a diesel oil flow rate of about 0.6 gallons per minute and a total air flow rate of about 900 SCFM.

Thermocouples were positioned on the secondary air conduit and about 14 inches below the top surface of the fragmented mass for temperature measurements. The following table shows the temperature reached after six minutes of burner operation and after thirty minutes of burner operation.

| Thermocouple | Temperature (°F.) | |
|---|---|---|
| | 6 minutes | 30 minutes |
| 1 | 1716 | 1757 |
| 2 | 1655 | 1720 |
| 3 | 1661 | 1737 |
| 4 | 1682 | 1750 |
| 5 | 1548 | 1565 |
| 6 | 944 | 952 |
| 7 | 133 | 139 |
| 8 | 108 | 116 |
| 9 | 102 | 113 |
| 10 | 104 | 113 |
| R-1 | 977 | Inoperable |
| R-2 | 712 | 968 |

Thermocouple number 1 was located at the bottom of the secondary air conduit. Thermocouples 2 through 10 were located at 12 inch intervals above the bottom of the secondary air conduit. Thus, for example, thermocouple number 5 was four feet above the bottom of the conduit, and the lower end of the primary air pipe was at an elevation between thermocouples 5 and 6. Thermocouple number R-1 was 14 inches below the top surface of the fragmented mass directly below the secondary air conduit. Thermocouple number R-2 was about one foot laterally from thermocouple R-1. Thermocouple R-1 failed in less than thirty minutes and no temperature measurement was obtained.

Such a burner has been used for igniting an experimental in situ oil shale retort. Flow of diesel fuel was about 0.5 to 0.6 gallons per minute. Primary air flow was about 130 to 150 SCFM and secondary air flow was about 850 to 900 SCFM. In addition about 60 to 70 SCFM of air was introduced through the annulus between the secondary air conduit and the bore hole through unfragmented formation above the fragmented mass for cooling.

Although the burner system and method for igniting an in situ oil shale retort have been described and illustrated herein in but one embodiment, many modifications and variations will be apparent to one skilled in the art. The dimensions mentioned are merely illustrative and the description is not considered to be limiting except as recited in the following claims.

What is claimed is:

1. A method for igniting a fragmented permeable mass of formation particles in an in situ oil shale retort in a subterranean formation containing oil shale and having a void space between the top of the fragmented mass and overlying unfragmented formation, comprising the steps of:

forming a hole through unfragmented formation to the void space;

extending a conduit through the hole into the void space with an open end of the conduit adjacent the top surface of the fragmented mass;

centering in the conduit a burner assembly comprising a primary air pipe having an open end within the conduit and spaced apart from the open end of the conduit, and a fuel atomizing nozzle within the primary air pipe and spaced apart from the open end of the primary air pipe;

introducing liquid fuel through the fuel atomizing nozzle, primary air through the primary air pipe, and secondary air through the annulus between the primary air pipe and the conduit for vortical flow of the secondary air past the open end of the primary air pipe; and igniting such fuel for producing a heated ignition gas from the open end of the conduit.

2. A method as recited in claim 1 wherein the fuel is selected from the group consisting of diesel oil and heated shale oil.

3. A method as recited in claim 1 wherein the conduit extends vertically into the void space and including the step of impinging heated ignition gas from the conduit on the top surface of the fragmented mass.

4. A method as recited in claim 3 wherein the open end of the conduit is about two feet above the top surface of the fragmented mass.

5. A method as recited in claim 1 wherein the amount of primary air plus secondary air is more than sufficient for stoichiometric burning of the fuel.

6. A method as recited in claim 1 wherein the open end of the primary air pipe is a sufficient distance from the open end of the conduit for substantially complete combustion of the fuel within the conduit.

7. A burner for igniting a fragmented permeable mass of particles containing oil shale in an in situ oil shale retort having an open void space between the top surface of the fragmented mass and overlying unfragmented formation comprising:

a generally vertical conduit having an open end spaced above a fragmented mass of particles in such an in situ oil shale retort;

a primary air pipe within the conduit having an open lower end spaced above the open end of the conduit;

means for centering at least the lower end of the primary air pipe in the conduit;

a liquid fuel atomizing nozzle within the primary air pipe spaced above the open end of the primary air pipe; and means spaced above the open end of the primary air pipe for imparting vortical flow to secondary air flowing through the annulus between the primary air pipe and the surrounding conduit.

8. A burner as recited in claim 7 wherein the means for imparting vortical flow comprises a plurality of vanes in the annulus between the primary air pipe and the conduit, the vanes extending around the primary air pipe substantially less than the full periphery of the conduit and being tilted relative to a plane normal to the axis of the primary air pipe.

9. A burner as recited in claim 7 further comprising separate means for introducing liquid fuel to the nozzle, introducing primary air to the primary air pipe, and introducing secondary air to the conduit.

10. A burner as recited in claim 7 further comprising means adjacent the upper end of the conduit for adjustably clamping the primary air pipe at any of a plurality of selected vertical positions in the conduit.

11. A burner as recited in claim 7 wherein the conduit comprises:

an outer casing cemented in unfragmented formation;
a landing ring inside the casing;
an inner conduit within the casing; and
a flange on the upper end of the inner conduit for engaging the landing ring inside the casing for supporting the inner conduit in the outer casing.

12. A burner as recited in claim 7 wherein the fuel nozzle is spaced above the open end of the primary air pipe about one diameter of the primary air pipe.

13. A burner as recited in claim 12 wherein the open end of the primary air pipe is a sufficient distance above the open end of the conduit for substantially complete combustion of fuel within the conduit.

14. A burner as recited in claim 7 wherein the open end of the primary air pipe is a sufficient distance above the open end of the conduit for substantially complete combustion of fuel within the conduit.

* * * * *